United States Patent [19]

Hoshino

[11] Patent Number: 4,948,378

[45] Date of Patent: Aug. 14, 1990

[54] WATERPROOF ELECTRICAL CONNECTOR ASSEMBLY

[75] Inventor: Haruo Hoshino, Chiba, Japan

[73] Assignee: Thomas & Betts Corporation, Bridgewater, N.J.

[21] Appl. No.: 317,895

[22] Filed: Mar. 2, 1989

[51] Int. Cl.[5] ..... H01R 13/52

[52] U.S. Cl. ..... 439/271; 439/519

[58] Field of Search ..... 439/81, 271, 519, 587, 439/588, 862

[56] References Cited

U.S. PATENT DOCUMENTS

| | | | |
|---|---|---|---|
| 3,082,398 | 3/1963 | Valach | 339/176 |
| 3,594,696 | 7/1971 | Witek, Jr. | 339/60 |
| 3,851,294 | 11/1974 | Palazzetti et al. | 339/17 |
| 4,162,116 | 7/1979 | Lehmann | 339/60 |
| 4,169,641 | 10/1979 | Olsson | 339/17 |
| 4,253,719 | 3/1981 | McGinley | 339/61 |
| 4,334,728 | 6/1982 | Reynolds et al. | 339/74 |
| 4,583,800 | 4/1986 | Roberts et al. | 339/74 |
| 4,630,874 | 12/1986 | Renn et al. | 339/17 |
| 4,634,195 | 1/1987 | Shoemaker | 339/17 |
| 4,639,063 | 1/1987 | Mueller | 339/75 |

FOREIGN PATENT DOCUMENTS

| | | | |
|---|---|---|---|
| 2844346 | 4/1979 | Fed. Rep. of Germany | 339/17 |
| 2027560 | 2/1980 | United Kingdom | 339/60 |

*Primary Examiner*—Steven C. Bishop

*Attorney, Agent, or Firm*—Robert M. Rodrick; Salvatore J. Abbruzzese

[57] ABSTRACT

A board is provided with a plurality of spaced conductors, covered by a waterproof film on one surface thereof, with a window through the film exposing selected portions of the conductors. A connector housing supports a plurality of electrical contacts that are brought into electrical management with the conductors through the window. A compressible ring surrounds the housing contacts and the window and is sandwiched between the board and the housing. A spring-biased holding member, latched to the housing, urges the board resiliently toward the housing, causing the electrical engagement between the board conductors and the housing contacts and also compressing the ring around the window to provide a waterproof seal around the electrical junctures.

7 Claims, 2 Drawing Sheets

WATERPROOF ELECTRICAL CONNECTOR ASSEMBLY

FIELD OF THE INVENTION

The present invention relates to an electrical connector assembly and, more particularly, to an electrical connector assembly that is useful for waterproof applications.

BACKGROUND OF THE INVENTION

Various conventional waterproof connectors have been proposed. Many of these connectors have complicated structures that have a tendency to decrease the operability of the connectors, as a result of the waterproofing effect. Additionally, with waterproof connectors waterproofing cannot usually be provided to a member connected to the connector. The present device has been proposed in consideration of this situation, and it is an object to provide a waterproof connector as a connector assembly having a simple structure and good operability so as to eliminate conventional drawbacks.

SUMMARY OF THE INVENTION

It is a primary object of the invention to provide an improved waterproof connector assembly.

In accordance with a preferred form of the invention, a waterproof connector assembly comprises a board having opposite surfaces and including a plurality of conductors thereon, the conductors being exposed at one of the surfaces. A housing supports a plurality of contacts in electrical engagement with the exposed conductors. A compressible member, supported by the housing, circumscribes the contacts and is disposed between the board and the housing. A holding member supported by the housing includes a resilient portion for resiliently urging the board toward the housing and thereby causing electrical engagement between the conductors and the contacts and compressing the compressible member between the housing and the board to provide a waterproof seal around the engaged conductors and contacts.

DETAILED DESCRIPTION OF THE PREFERRED EMBODIMENT

Figure 1A:
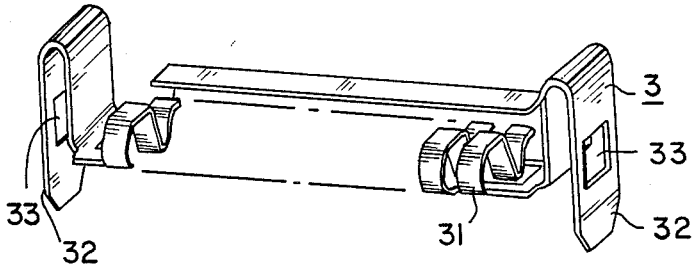
FIGS. 1A, IB and IC are perspective views showing the respective elements of one embodiment of the present connector assembly.
Figure 1B:
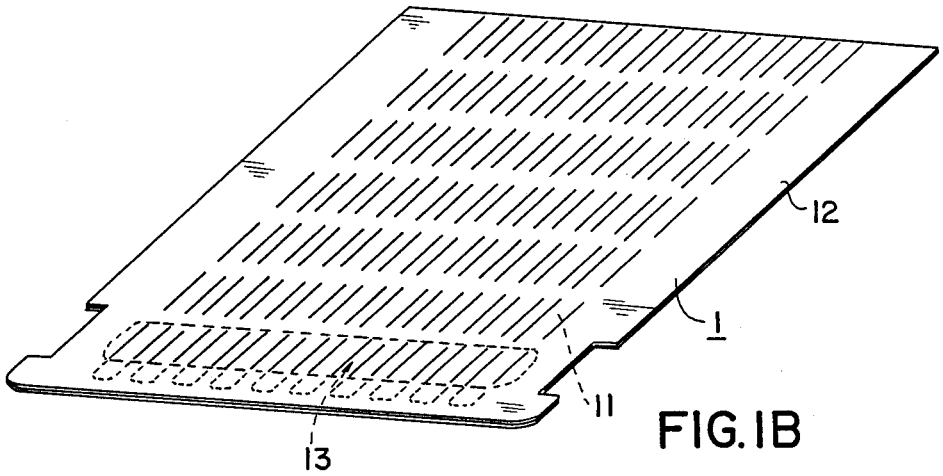
Figure 1C:
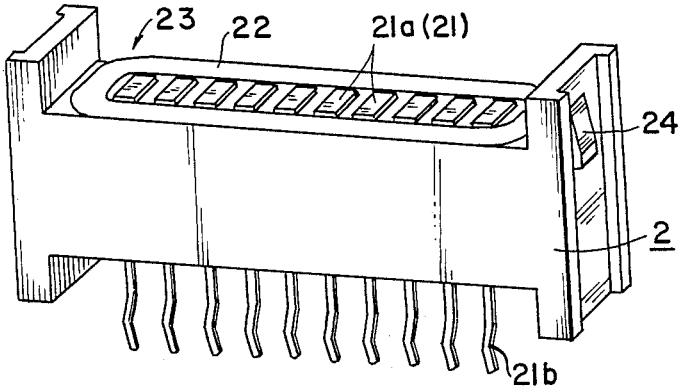

Referring now to FIGS. 1A through 1C, a connector of the present device is shown with a member connected thereto, such as a printed circuit board 1. A housing 2 of the connector includes a plurality of contacts 21 at suitably spaced pitches. The housing 2 has a board insertion recessed portion 23 for inserting the board 1. Distal end portions 21*a* of the contacts are exposed in the board insertion portion 23. In a connecting state, described hereinafter, the contacts 21 are in contact with conductors portions of conductor parts 11 of the printed circuit board 1, respectively. Opposite end portions of the contacts constitute depending legs 21*b* to be connected to another printed circuit board 4.

A packing member 22, such as an elastomeric ring, is disposed in the substrate insertion portion 23 of the housing so as to surround the plurality of contacts, as shown in FIG. 1C.

The printed circuit board 1 connected to the housing 2 includes the conductor parts 11 which are to be electrically connected to electric components mounted on the board or other electric components through the board. The surfaces of the conductor parts 11 are coated with a suitable waterproof film or, alternatively, a waterproof insulating layer 12 is formed thereon. An elongated window 13 is formed through the insulating layer portion which is brought into contact with the end portions 21*a* of the contacts 21 in the housing. The edge of the window 13 is located inside the edge of the board 1. The engagement areas between the contacts 21 and the board 1 are waterproofed by pressing the packing member 22 on the edge of the window so as to prevent water from entrance.

Reference numeral 3 in FIG. 1A denotes a cap member for holding and pressing the printed circuit board 1 on the contacts 21 in the housing 2. In the illustrated embodiment, the ends of the cap member 3 all have depending flanges 32 with openings 33 therethrough which are engaged with latches 24 arranged at the end faces of the housing 2. In the present device, the latching means is not limited to the specific latch shown.

To cause the cap member 3 to press the board 1 against the housing 2, a spring effect is provided in the cap member 3. In the illustrated embodiment, spring members 31 are disposed in the cap member 3. However, other spring effects may also be provided to the contacts.

Figure 2:
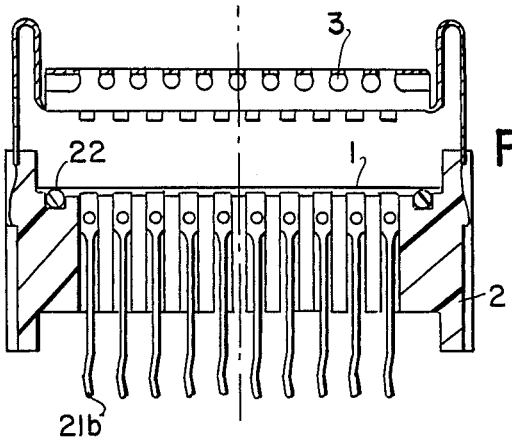
FIG. 2 is a longitudinal sectional view of the connector assembly of FIG. 1.
Figure 3:
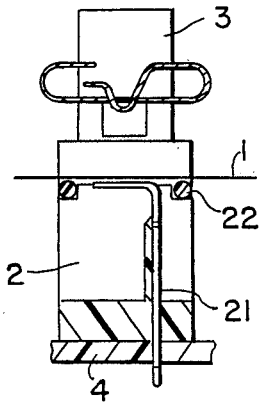
FIG. 3 is a transverse cross-sectional view of the assembly of the connector assembly of FIG. 1.

FIGS. 2 and 3 show states wherein the connector is about to be connected to the printed circuit board 1. In the connector state, the contact portions between the conductors parts 11 of the board and the contacts 21 are waterproofed by the peripheral portion of the window 13 surrounding the contact portions and the packing member 22 so as to prevent waterdrops from entering the contact portions.

The connector assembly as the present device is provided to have good waterproof properties that result when the board is inserted in the board insertion portion 23 of the housing 2 and is held by the holding action of the cap member 3. Therefore, good electrical connections between the board and the contacts can be achieved, and at the same time the contact portions waterproofed. As such, operability is desirably improved relative to a conventional waterproof connector.

Having described the preferred embodiment of the present invention, it should be appreciated the variations may be made thereto without departing from the contemplated scope of the invention. Accordingly, the preferred embodiment is considered as illustrative rather than limiting, the true scope of the invention being set forth in the claims appended hereto.

I claim:

1. A waterproof connector assembly, comprising:

a board (1) having opposite surfaces and including a plurality of conductors (11) thereon, said conductors (1) being exposed at one of said board surfaces, said conductors (1) being covered with a waterproof, insulating film (12), a window (13) being formed through said film (12) of size to expose selective portions of all conductors through said window (13), said window (13) being disposed fully within the edges of said board;

a housing (2) supporting a plurality of contacts (21) in electrical engagement with said exposed conductors;

a compressible member (22) supported by said housing and circumscribing said contacts, said compressible member (22) being disposed between said board and said housing; and a holding member (3) supported by said housing and including a resilient portion for resiliently urging said board toward said housing (2), thereby causing electrical engagement between said conductors (1) and said contacts (21) and compressing said member (22) between said housing (2) and said board (1) to provide a waterproof seal around the engaged conductors (1) and contacts (21).

2. An assembly according to claim 1, wherein said housing includes a recessed portion (23) within which said board is received.

3. An assembly according to claim 1, wherein said holding member (3) comprises a generally elongate member including a plurality of spring members (31) extending longitudinally thereon, each spring member (31) being in engagement with the other surface of said board (1) and biasing said board toward said housing.

4. An assembly according to claim 3, wherein said holding member (3) comprises a pair of flanges (32) in cooperative latching engagement with latches (24) on said housing.

5. An assembly according to claim 1, wherein said compressible member (22) comprises an elastomeric ring.

6. An assembly according to claim 5, wherein said window (13) defines an exposed area of conductors not greater than an area defined by said elastomeric ring.

7. An assembly according to claim 6, wherein said exposed area of conductors is defined by an edge of said window, said elastomeric ring being compressed against said window edge.

* * * * *